US007104262B2

(12) United States Patent
Yorns et al.

(10) Patent No.: US 7,104,262 B2
(45) Date of Patent: Sep. 12, 2006

(54) VERSATILE HOOK FOR HANGING AND STORING AIRGUNS

(75) Inventors: Mark W. Yorns, Longmeadow, MA (US); Thomas C. Tremblay, Concord, MA (US); James W. Fletcher, Wilbraham, MA (US); Brian T. Donovan, Belchertown, MA (US)

(73) Assignee: Guardair Corporation, Chicopee, MA (US)

( * ) Notice: Subject to any disclaimer, the term of this patent is extended or adjusted under 35 U.S.C. 154(b) by 78 days.

(21) Appl. No.: 10/971,436

(22) Filed: Oct. 21, 2004

(65) Prior Publication Data

US 2005/0098691 A1 May 12, 2005

Related U.S. Application Data

(60) Provisional application No. 60/513,517, filed on Oct. 21, 2003.

(51) Int. Cl.
*A47G 29/08* (2006.01)

(52) U.S. Cl. ..... 124/10; 248/126; 248/689; 42/85

(58) Field of Classification Search ..... 124/10; 248/689–692, 312, 316.1, 126; 215/399; D8/367, 396; 42/85
See application file for complete search history.

(56) References Cited

U.S. PATENT DOCUMENTS 2,227,779 A * 1/1941 Grant ..... 239/531

* cited by examiner

*Primary Examiner*—Michael J. Carone
*Assistant Examiner*—Bret Hayes
(74) *Attorney, Agent, or Firm*—Holland & Bonzagni, P.C.; Donald S. Holland, Esq.

(57) ABSTRACT

A versatile book is disclosed for hanging pneumatically actuated devices (e.g., airguns or spray guns). In the preferred embodiment, the versatile hook comprises: a hook body having a base with an annular section that defines a through-space corresponding to the shape of the pneumatic device's cylindrical extension tube or barrel; a hook-shaped extension attached to the body; and, positioning-and-mounting means for selectively positioning the hook, around and along the barrel, and thereafter mounting the body in a temporarily fixed position onto the barrel, with the hook-shaped extension facing towards or away from the discharge nozzle. Upon loosening a bolt, the preferred hook can be reoriented.

9 Claims, 3 Drawing Sheets

VERSATILE HOOK FOR HANGING AND STORING AIRGUNS

This Utility patent application is based upon an earlier Provisional Patent Application, Ser. No. 60/513,517, filed Oct. 21, 2003. Applicant claims the benefit of priority from the Provisional Application. Applicant also hereby incorporates the Provisional Application by reference.

FIELD

The present invention relates to accessories for hand-held devices that utilize pressurized fluid flow, such as air guns and spray guns.

BACKGROUND

Airguns are devices for applying a controlled stream of high-pressure air to an industrial fixture or another surface, typically for purposes of removing debris or other cleaning. As such, airguns are part of a system comprising an air compressor or other source of pressurized air, a length of flexible hose connecting the compressor to the airgun, and the airgun itself. The airgun typically includes a handle, a trigger for controlling the air flow, an extension tube (a.k.a. barrel) for directing the flow, and a nozzle for shaping the discharged flow.

Spray guns, water guns, and oil guns work on similar principles, since all include a fluid flow control device that works off a pressurized source. Such "guns" usually include a mechanism for controllably siphoning and metering a stream of liquid into controlled air flow, for purposes of, e.g., painting or cleaning.

Airguns are most frequently used in industrial settings. For hanging or other storage near machine tools or other workstations, airguns have included a hanger or hook built in as part of the airgun body, i.e., the hook is integral to the body casting. However, because the hook is part of the airgun body, it is immobile, and its position cannot be changed or adjusted by end users. Airguns are manufactured in a wide variety of sizes, shapes, and lengths. When attached to the flexible hose, the center of gravity of the unit may be quite different than the airgun by itself. Thus, airguns can become quite awkward to hang or store in a manner which lends itself to easy operator access and safety, i.e., the easier an airgun is to hang the more likely a user will store it safely. Moreover, existing built-in hooks (e.g., eyelets) tend to be small, and oftentimes cannot accommodate anything larger than a diameter of ⅜".

In addition to a lack of operational flexibility, built-in hooks often break off during use. This is because built-in hooks are typically made out of the same material as the body casting, namely, die cast aluminum or zinc. Metal is fine for airgun bodies, but is brittle and easily broken in the context of less substantial features such as hooks or hangers. Moreover, because broken aluminum is difficult and impractical to reattach to itself, the broken hooks are virtually impossible to reattach via an adhesive or the like. Also, because they are part of the cast airgun body, they cannot be replaced outright.

Accordingly, a primary object of the present invention is to provide a hook or hanger for airguns that has much greater operational flexibility, that resists breaking, and that can be easily replaced.

SUMMARY

A versatile hook for hanging and storing airguns comprises an annular body and a hook-shaped extension integral with the annular body. In a preferred embodiment, the body and extension are both made of durable plastic. The annular body defines a cylindrical through-space. Near its base, the body is "split." That way, one "side" of the body can be shifted, away from the other side, to selectively increase the size (i.e., effectively increase the diameter) of the through-space for application or removal. The two sides can be held together, via a nut and bolt that extends through the body, to secure the extension hook to an airgun. The hook-shaped extension is oversized compared to existing, integral hooks, so as to fit over large-diameter objects (e.g., piping or railing).

In use, the versatile hook is first attached to an airgun by placing the body portion of the hook over a cylindrical-shaped portion of the airgun (typically, the barrel of the airgun proximate the discharge nozzle). To do this, the nut and bolt are loosened, and the two sides of the body are pulled away from each other, increasing the size of the through-space. (As should be appreciated, the annular-shaped portion of the body flexes to accommodate this movement, by virtue of being made from a flexible polymer material.) Then, the versatile hook is slipped over the airgun, appropriately positioned, and secured by tightening the nut and bolt. Subsequently, the airgun can be easily stored or otherwise hung from tubing, piping, railing, or storage hooks by way of the versatile hook. In addition, the versatile hook can be repositioned or reoriented on the airgun, both radially and longitudinally (relative to the barrel), upon loosening the nut and bolt. Thus, the hook can be uniquely positioned so as to balance the airgun and optimize its accessibility, given the specifics of the gun itself, the attached hose, and the constraint of the workspace.

DETAILED DESCRIPTION

Figure 1:
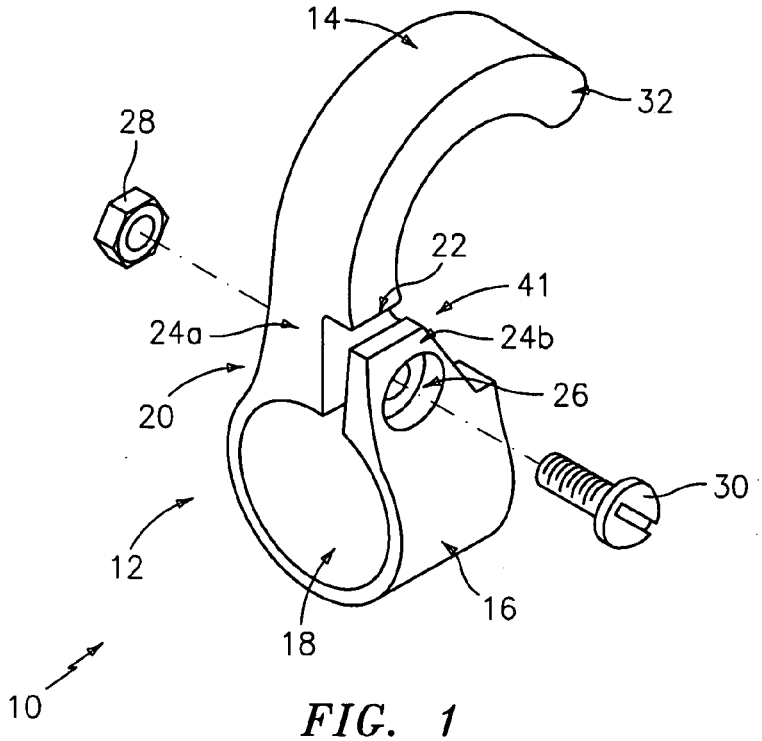
FIG. 1 is an exploded perspective view of a versatile hook for hanging and storing airguns.
Figure 2:
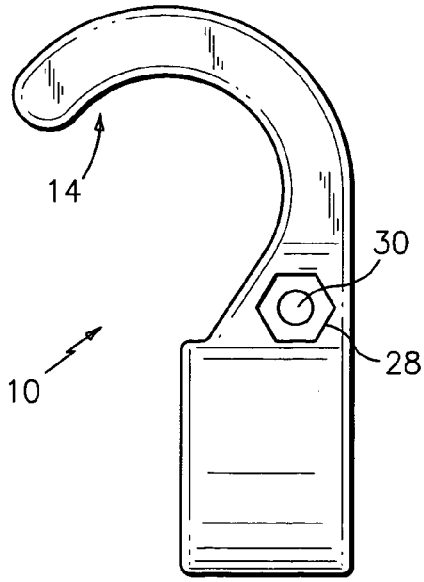
FIG. 2 is a plan view of an opposite side of the hook depicted in FIG. 1.

FIGS. 1–6 show a preferred embodiment of a versatile hook 10, for hanging and storing airguns, constructed according to the present invention. The preferred hook 10 includes a body 12 and a hook-shaped extension 14 integral with the body 12. Overall, the body 12 is generally ring-shaped and has: an annular section or collar 16, which defines a cylindrical through-space 18; and a base 20. The base (collar) 20 is radially split along a split line 22 such that the base 20 can be "opened," i.e., the two sides 24*a*, 24*b* of the body that normally nestle together can be temporarily pried apart. A fastener aperture 26 extends through the base 20 and is used, in conjunction with a nut 28 and screw or bolt 30, to secure the base sides 24*a*, 24*b* together.

The body 12 and hook-shaped extension 14 are both made of a durable polymer or plastic material. The polymer is slightly flexible so that the annular section 16 of the body 12 can flex when the base halves 24*a*, 24*b* are pried or pulled apart. One suitable material is Acetal (Celcon M90), which is flexible to ease installation, yet suitably strong so that the versatile hook will not break during use.

The preferred hook-shaped extension 14 is dimensioned to fit over standard pipe (e.g., ½" Schedule 80 Nominal Pipe Size). In addition, the end portion 32 of the extension 14 is dimensioned to fit into holes or other openings having a diameter of ½" or larger.

The versatile hook 10 is meant to be installed or attached to an airgun 40, via a positioning-and-mounting means, such as the type 41 shown in FIGS. 3–6. The positioning-and-mounting means 41 is used to removably install the hook 10 in a variety of possible positions around and along the longitudinal axis of an extension tube portion 42 of the airgun 40. (The extension tube is a cylindrical air tube or barrel located between the airgun's body 44 and nozzle 46.) For this purpose, the annular section 16 of the hook body 12 will have an inner diameter that generally matches the outer diameter of the portion of the airgun to which the versatile hook 10 is meant to be attached. For example, if the extension tube 42 in FIG. 6A has an outer diameter of ¾", the annular section 16 will have an inner diameter of about ¾". Of course, the versatile hook 10 can be configured to fit on airguns having different-sized bodies or extension tubes, or can be configured to fit on, or otherwise attach to, portions of airguns that are not cylindrical in shape (not shown).

To install the versatile hook 10, the sides 24*a*, 24*b* of the split base 20 are slightly pried or pulled apart, temporarily increasing the size of the through-space 18. The versatile hook 10 is then slipped over the airgun's extension tube 42, and positioned and oriented, as desired, both along and around the tube's longitudinal axis. Subsequently, the versatile hook 10 is removably locked into place by inserting the screw or bolt 30 through the fastener aperture 26 and securely screwing it into the nut 28, previously placed on the other side of the base 20. There are no protruding flanges or "ears," such as those associated with ring clamps, for connecting the split base together. Other than hook 10, only the head of the bolt 30 and the nut 28 protrude from the sleek base 20. To ease assembly, the nut 28 may be press fit into the base 20. This reduces the number of loose pieces that need handling during installation and/or repositioning of the hook.

Figure 3:
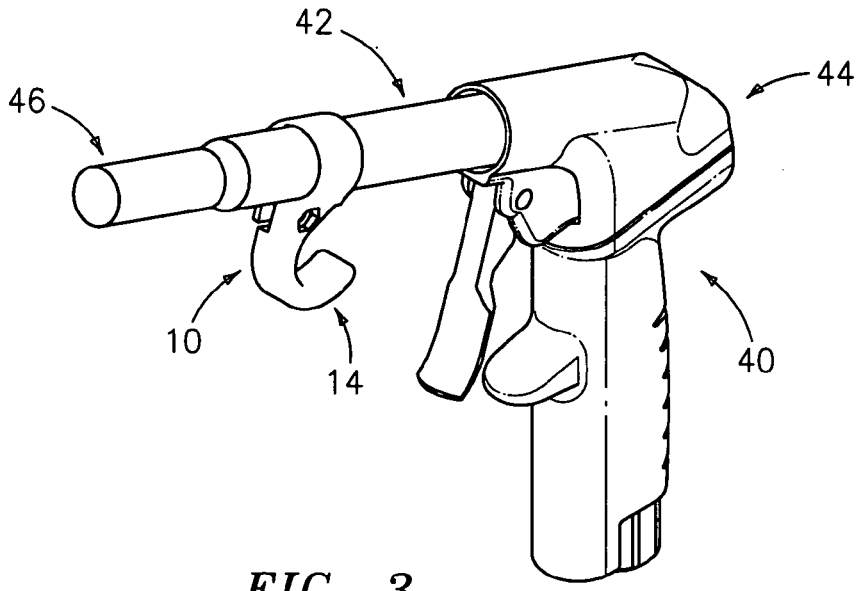
FIGS. 3–6 are perspective views of the hook mounted in different orientations on a safety airgun.
Figure 4:
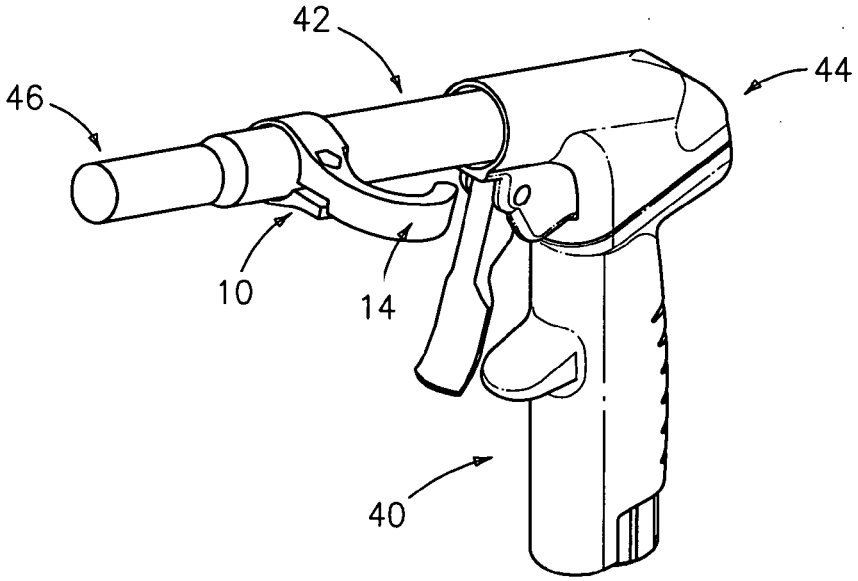
Figure 5:
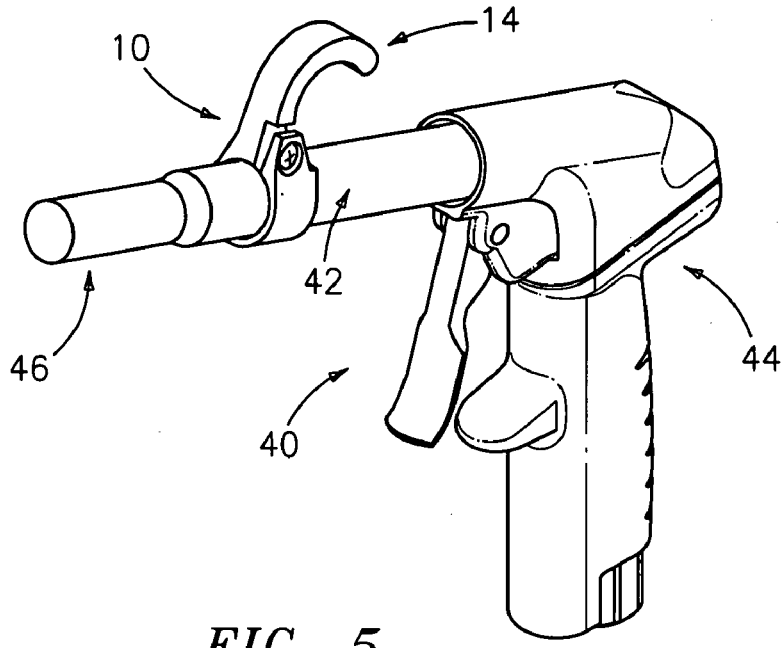
Figure 6:
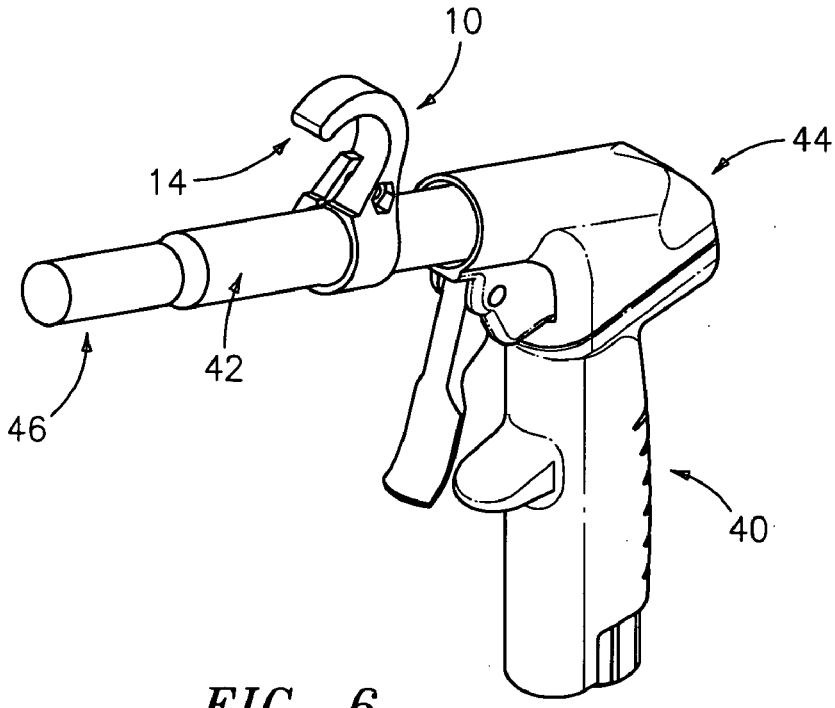

Once installed, the versatile hook 10 (upon loosening of the bolt 30) can be rotated and repositioned anywhere around and along the exposed portion of the cylindrical extension 42, as can be seen by comparing FIGS. 3 and 6. In other words, the hook can be positioned anywhere along the 360° of a circle, and it can be slid to-and-fro along the tube. The versatile hook 10 can also be turned around or flipped over, so that it faces "front" (i.e., see FIG. 6 where the hook's distal end portion 32 is closest to the nozzle) or "back" (i.e., see FIG. 5 where the end 32 is flipped around). Due to its possible orientations, the versatile hook 10 can be used to hang an airgun from a number of different objects (piping, railing, etc.) depending on the particular job and/or needs of the end user. Also, in the unlikely event the versatile hook 10 ever breaks, it can be easily replaced with another unit.

The versatile hook can be used to hang any hand-held, pneumatically actuated device having a barrel, such as a spray gun, water gun, or oil gun.

Although the versatile hook of the present invention has been illustrated as being made of a polymer/plastic, one of ordinary skill in the art will appreciate that the hook could also be made of other materials, such as metal, without departing from the spirit and scope of the invention.

Also, although the preferred hook has been disclosed as being dimensioned to fit over cylindrical objects (e.g., pipes), it should be appreciated that the hook body could be constructed with different geometries to fit over larger or different-shaped objects. Geometries other than cylindrical might prevent the 360° rotational freedom-of-movement, described above.

Also, although the versatile hook has been illustrated as a unitary piece with a split base, it should be appreciated that it could also be provided as two separate pieces connected by screws/bolts and nuts (not shown) or as two separate pieces connected at one end via a hinge or the like (not shown).

Since certain changes may be made in the above-described versatile hook for hanging and storing airguns, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. In a system of the type having an air compressor and a length of flexible hose connecting the compressor to an airgun, wherein the airgun includes a handle, a trigger for controlling the air flow, a generally cylindrical extension tube for directing the flow, and a discharge nozzle for shaping the discharged flow, the improvement comprising:

a. a hook body having a base with an annular section adapted in size and shape to define a cylindrical through-space;

b. a hook-shaped extension attached to the body; and, c. positioning-and-mounting means for selectively orienting the body anywhere radially around and along a longitudinal axis of the cylindrical extension tube of the airgun and thereafter mounting the body in a temporarily fixed position, with the hook-shaped extension selectively facing towards or away from the discharge nozzle, whereby the hook can be reoriented, even flipped over to face in an opposite direction, depending on the storage needs of an end user.

2. The system of claim 1, wherein positioning-and-mounting means includes means for sliding the hook body along a longitudinal axis of the cylindrical tube.

3. The system of claim 2, wherein the positioning-and-mounting means comprises:

i. the base is split to form two sides that normally abut one another but that can be pulled apart to temporarily increase the size of the through-space; and ii. a fastener aperture extends through the two base sides, whereby the two base sides can be secured together, without the need for protruding flanges such as those found in ring clamps, using a nut and bolt or other fastener extending through the fastener aperture.

4. A hook for storing airguns, wherein the hook comprises:

a. a hook body having a base with an annular section adapted in size and shape to define a cylindrical through-space;

b. a hook-shaped extension attached to the body; and, c. positioning-and-mounting means for selectively orienting the body anywhere radially around the cylindrical extension tube of an airgun and thereafter mounting the body in a temporarily fixed position, with the hook-shaped extension facing towards or away from the discharge nozzle, whereby the hook can be reoriented, even flipped over to face in an opposite direction, depending on the storage needs of an end user, wherein the positioning-and-mounting means comprises:

i. the base is split to form two sides that normally abut one another but that can be pulled apart to temporarily increase the diameter of the cylindrical through-space, wherein the base does not have protruding flanges for connecting the sides together; and ii. a fastener aperture extends through the two base sides, whereby the two base sides can be secured together using a nut and bolt or other fastener extending through the fastener aperture.

5. In an pneumatically actuated device of the type having a source of pressurized air and a length of flexible hose connecting the source to the pneumatic device, wherein the device includes a handle, a trigger for controlling the air flow, a cylindrical barrel for directing the flow, and a discharge nozzle for shaping the discharged flow, the improvement comprising:

a. a hook body having a base with an annular section adapted in size and shape to define a cylindrical through-space;

b. a hook-shaped extension attached to the body; and, c. positioning-and-mounting means for selectively orienting the body anywhere radially around the barrel and thereafter mounting the body in a temporarily fixed position, without the need for protruding flanges such as those found in ring clamps, with the hook-shaped extension selectively facing towards or away from the discharge nozzle, whereby the hook can be reoriented, even flipped over to face in an opposite direction, depending on the storage needs of an end user.

6. The system of claim 5, wherein the positioning-and-mounting means includes means for sliding the hook body along a longitudinal axis of the barrel.

7. The system of claim 6, wherein the positioning-and-mounting means comprises:

i. the base is split to form two sides that normally abut one another but that can be pulled apart to temporarily increase the size of the through-space; and ii. a fastener aperture extends through the two base sides, whereby the two base sides can be secured together using a nut and bolt or other fastener extending through the fastener aperture.

8. In an pneumatically actuated device of the type having a source of pressurized air and a length of flexible hose connecting the source to the pneumatic device, wherein the device includes a handle, a trigger for controlling the air flow, a barrel for directing the flow, wherein the barrel has a generally constant shape along the barrel, and a discharge nozzle for shaping the discharged flow, the improvement comprising:

a. a hook body having a base with an annular section adapted in size and shape to define a through-space that corresponds to the shape of the barrel;

b. a hook-shaped extension attached to the body; and, c. positioning-and-mounting means for selectively positioning and thereafter mounting the body in a temporarily fixed position onto the barrel, with the hook-shaped extension facing towards or away from the discharge nozzle, whereby the hook can be reoriented, even flipped over to face in an opposite direction depending on the storage needs of an end user, wherein:

i. the base is split to form two sides that normally abut one another but that can be pulled apart to temporarily increase the size of the through-space; and ii. a fastener aperture extends through the two base sides, whereby the two base sides can be secured together using a nut and bolt or other fastener extending through the fastener aperture.

9. The system of claim 8, wherein the positioning-and-mounting means includes means for sliding the hook body along the barrel.

* * * * *